United States Patent [19]

Fegley

[11] 4,079,862

[45] * Mar. 21, 1978

[54] CHEMICAL DISPENSING ANTI-BURGLARY BOOBY TRAP DEVICE

[76] Inventor: Charles R. Fegley, 1606 Flush Valley Rd., Laureldale, Pa. 19605

[ * ] Notice: The portion of the term of this patent subsequent to Apr. 23, 1991, has been disclaimed.

[21] Appl. No.: 672,606

[22] Filed: Apr. 1, 1976

Related U.S. Application Data

[63] Continuation-in-part of Ser. No. 546,667, Feb. 3, 1975, which is a continuation-in-part of Ser. No. 349,300, Apr. 9, 1973, abandoned.

[51] Int. Cl.[2] ..... B67D 5/12

[52] U.S. Cl. ..... 222/162; 222/183

[58] Field of Search ..... 222/5, 180, 398, 402.11, 222/162, 509, 183; 239/274

[56] References Cited

U.S. PATENT DOCUMENTS

| | | | |
|---|---|---|---|
| 3,032,788 | 5/1962 | Lowther, Jr. | 222/5 X |
| 3,147,885 | 9/1964 | Sheridan | 222/5 |
| 3,150,800 | 9/1964 | Weber | 222/180 X |
| 3,224,644 | 12/1965 | Davis | 222/162 |
| 3,285,469 | 11/1966 | Perisse | 222/162 X |
| 3,344,959 | 10/1967 | Faso | 222/162 X |
| 3,494,506 | 2/1970 | Fujimoto | 222/5 |
| 3,809,319 | 5/1974 | Kimura | 222/180 X |
| 3,952,916 | 4/1976 | Phillips | 222/162 X |

FOREIGN PATENT DOCUMENTS

| | | | |
|---|---|---|---|
| 1,912,018 | 3/1969 | Germany | 239/312 |
| 555,233 | 1/1957 | Italy | 9/316 |

*Primary Examiner*—Joseph F. Peters, Jr.
*Assistant Examiner*—Norman L. Stack, Jr.

[57] ABSTRACT

A chemical dispensing anti-burglary booby trap device is disclosed from which a chemical such as tear gas is discharged into the area to be protected when an intruder opens a window or opens a door or enters an unauthorized area with which the device is associated. The anti-burglary booby trap device employs a spring biased pressurized container for discharging a chemical from a pressurized container. A mechanical trigger for releasably retaining the pressurized container in a cocked position, an improved mechanical and electromechanical trigger to release the chemical, and a built-in safety to deactivate the device, which makes it virtually immpossible to accidentally discharge the device, are described.

17 Claims, 21 Drawing Figures

CHEMICAL DISPENSING ANTI-BURGLARY BOOBY TRAP DEVICE

This application is a continuation-in-part of Ser. No. 546,667, filed 2/3/75, which is a continuation-in-part of Ser. No. 349,300, filed 4/9/73, now abandoned.

BACKGROUND OF THE INVENTION

The invention relates generally to an anti-burglary booby trap device and more particularly to an anti-burglary booby trap device which discharges a chemical such as tear gas from a pressurized container into the protected area. Actuation by an unauthorized person causes the protected area to be flooded with the chemical and thereby forces evacuation of the protected area by the intruder.

Chemical weapons have been known in the art for many years. One type of chemical weapon is the conventional tear gas grenade which is generally triggered manually and the grenade is manually hurled at a target area, causing the target area to be flooded with the chemical.

In another type of chemical weapon, the chemical is stored under pressure in an aerosol type container. The actuating member is generally triggered manually and the chemical in the form of a spray is manually directed at a target.

A third type of chemical anti-burglary device discharges an explosive tear gas shell into the area but this type is both dangerous and very limited as to the amount of tear gas which is discharged into the area to be protected.

Thus what is needed is an anti-burglary booby trap device in the form of a chemical dispenser which can be discharged by a relatively small amount of mechanical force even though the device employs a relatively heavy spring for biasing the pressurized container to cause discharge when the pressurized container is released. The body member contains a dispensing element-actuating means for actuating the dispensing element of the pressurized container. The spring must be sufficiently strong to force the dispensing element-actuating means into engagement with and to actuate the dispensing element whereby the chemical is released from the pressurized container. In addition, the anti-burglary device can be positively secured against accidental release until triggered by an intruder. When triggered, the device will then release a sufficient volume of the chemical into the protected area to force evacuation by the intruder.

SUMMARY OF THE INVENTION

The principle object of the present invention is to provide an anti-burglary booby trap device of the chemical dispensing type which may be triggered directly by a small amount of mechanical movement, and yet is positively secured against accidental release.

An additional object of the invention is to provide an anti-burglary device of the chemical weapon type which is readily triggered by opening a door, window, or ceiling skylight by an intruder entering an unauthorized area or by moving an object with which the device is connected.

Another object of the invention is to provide an improved means of dispensing the chemical into the protected area in a minimum amount of time in order to force the intruder from the protected area and to prevent the intruder from re-entering the protected area for a reasonable amount of time.

Another object of the present invention is to provide a directable discharge of the chemical, such as by means of rotatably adjustable dispensing head, so that the invention might be located on a door, wall, or the like, and yet, when the device is actuated, the discharged chemical is directed into the area to be protected.

According to the principle aspect of the present invention there is provided an improved means for releasably retaining the spring biased pressurized container of the anti-burglary device in its cocked position. Such means includes a trigger adapted to be movably mounted between an actuation position and in a release position. A cord, cable, wire or the like, connects the trigger to a window, door or other object which might be moved by an unauthorized person entering a room or building, or across a walkway or other area from which it is desired to restrict unauthorized persons. When the trigger is in its actuation position, it retains the pressurized container in a cocked position. When the door or window associated with the device is opened by an unauthorized person, or when the object is moved by an unauthorized person or when the person enters the restricted area, the cord connected to the trigger moves the latter from engagement to a release position; thereby releasing and permitting the pressurized container to be thrust toward the dispensing element-actuating means by the force of the spring associated with the pressurized container and causing the chemical to be discharged into the protected area.

Since the trigger which serves to retain the pressurized container in its cocked position has mechanical advantage, a relatively small amount of force is required to move the trigger from engagement with the pressurized container. Even more important, a relatively small amount of force is required to move the trigger to discharge the chemical weapon, even though a relatively strong spring is employed for forcing the pressurized container toward the dispensing element-actuating means. As a consequence, the cord connected to the trigger in the present invention will not break in triggering the pressurized container. The resistance to movement of the cord connected to the trigger is sufficiently low so as not to be observed by an intruder. Nevertheless, the trigger serves to retain the pressurized container safely in its cocked position against accidental release.

Since the trigger element is slideably supported in a narrow slot and provided with a narrow opening to insert a cord with a narrow specially shaped loop on it; it is virtually impossible for a small child to activate the device when the cord is removed. In addition, a safety pin is provided as an additional safeguard against accidental discharge.

Alternatively, the chemical dispensing anti-burglary device may be connected to an electric circuit to effect discharge when the electric circuit is completed. The device may, therefore, be used in existing anti-intrusion or anti-burglary systems or may be connected to a switch and a power source. Upon energization, an electromechanical actuation releases the triggering element thereby releasing the pressurized container to cause the pressurized container to discharge its contents.

The anti-burglary device of the chemical weapon type of the present invention may be utilized in homes, factories, farms, office buildings by attaching the device to doors, windows, skylights, etc., and may be used in connection with boats, trucks, etc. The device may also be employed for any other application wherein it is desired to prevent unauthorized persons from moving certain objects by placing the mounted device against any wall or other object to prevent the unlocked device from discharging until unauthorized movement of the subject objects.

Once actuated, the dispensing action cannot be turned off by the intruder and the entire amount of the pressurized chemical will be discharged into the protected area making it impossible for the intruder to remain in the protected area without having protective equipment.

Other objects, aspects and advantages of the invention will become apparent from the following description taken in connection with the accompanying drawings.

DESCRIPTION OF THE PREFERRED EMBODIMENTS

Figure 1:
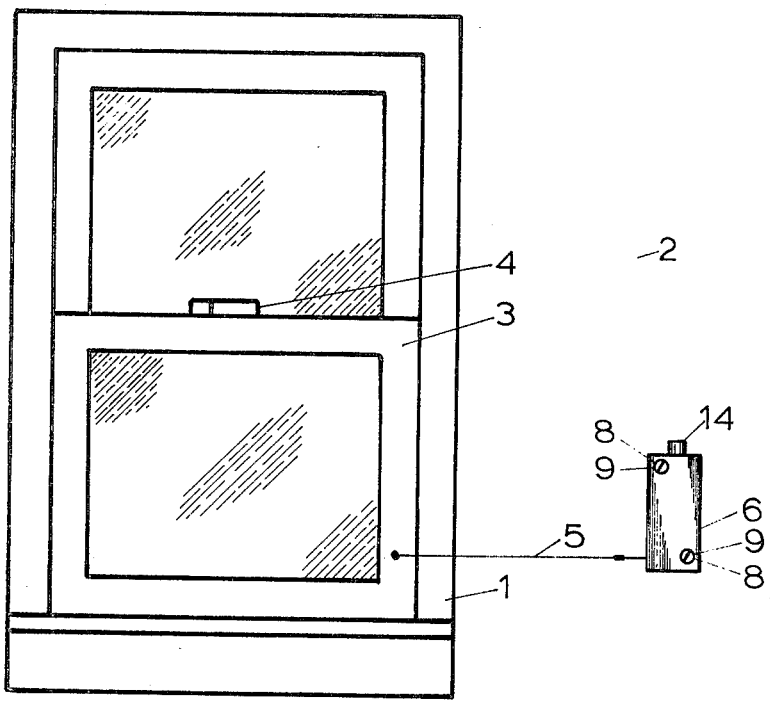
FIG. 1 is an elevational view of a wall of a room having one embodiment of the chemical dispensing anti-burglary device of the present invention secured to the wall and connected by means of a cord to the sash of a window in the wall.
Figure 2:
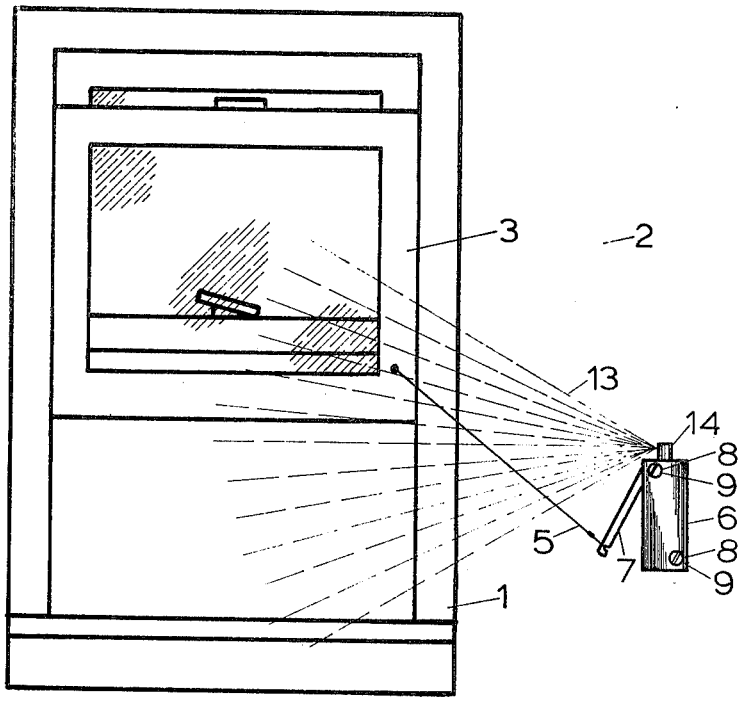
FIG. 2 is an elevational similar to FIG. 1, but showing the window open and showing the device discharging.
Figure 3:
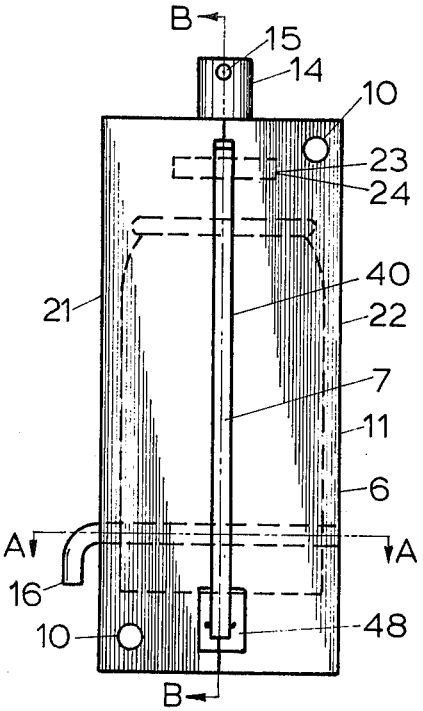
FIG. 3 is a front elevational view of the chemical dispensing anti-burglary device.

Referring now to the drawings in detail, wherein like reference characters designate like parts throughout the various views, there is shown in FIGS. 1–6, one form of the chemical dispensing anti-burglary device, called device hereafter, of the chemical dispensing type according to the present invention, generally designated 6. The device 6 is shown for convenience as being secured to a surface such as a wall 2 and connected by means of a cord 5 to a movable surface such as a window sash 3 in the wall 2 so that upon opening of the window sash 3 by a burglar or an intruder, the device 6 will be actuated to discharge a chemical 13 such as tear gas into the restricted area. The device 6 whose front is shown in FIG. 3 contains a pressurized chemical container 31, called pressurized container 31 hereafter, supported in a body member 11. The body member 11 is shown for convenience as being comprised of a left body half 21 and a right body half 22 and includes mounting means which is shown for convenience as holes 9 through body member 11 for attaching device 6 to the wall 2 or elsewhere as may be convenient with screws 8.

Figure 6:
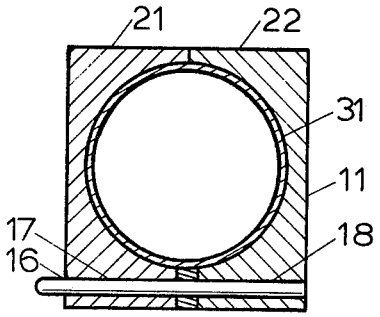
FIG. 6 is a partial horizontal section taken along line A—A of FIG. 3 with the trigger element cocked and locked by the safety pin.
Figure 5:
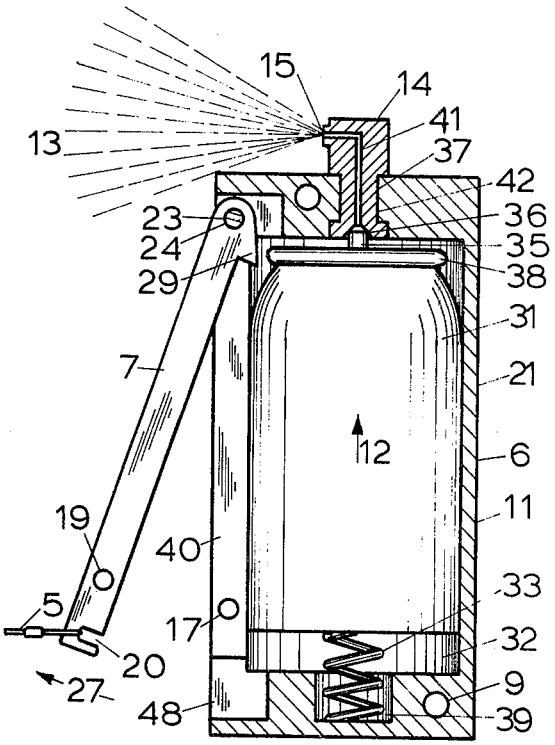
FIG. 5 is a vertical section taken along line B—B of FIG. 3 similar to FIG. 4 but showing the pressurized container in its release position after the device has been actuated.
Figure 4:
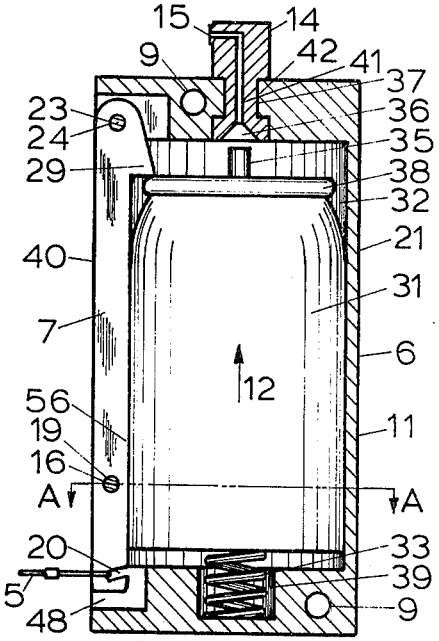
FIG. 4 is a vertical section taken along line B—B of FIG. 3 showing the pressurized container in its cocked position displaced from the open entry section of fluid passageway.

The coaxial cylindrical bores 32, 39 and 42, as shown in FIGS. 4, 5 and 6, are formed when the symetrically opposite body halves 21 and 22 are joined together. The cylindrical bore 32 slidably supports the pressurized container 31. The pressurized container 31 of which one type is sold by Defense Products Manufacturing Corporation, 1628 South Hanley Rd., St. Louis, Mo. identified as their "Paralyzer" and another type is sold by Penguin Industries, Inc., Parkesburg, Pa. identified as their "10-4 Chemical Billy" but the invention is not limited to the use of these containers. The pressurized container 31 includes a fluid dispensing element which comprises of a dispensing spout 35 which when depressed discharges a chemical 13 through the center of the dispensing spout 35.

The cylindrical bore generally designated 39 is coaxial with cylindrical bore 32 and provides a means for mounting the spring 33. Spring 33 is mounted to urge the pressurized container 31 in the direction 12.

Now referring to FIGS. 4 and 5, a passageway 41 is shown for convenience as being contained within a rotatable dispensing head 14. The dispensing head 14 has a cylindrical surface 37 which mounts in the cylindrical bore 42 whereby the passageway 41 is coaxial with the dispensing spout 35 of the pressurized container 31. The passageway 41 is shown as including an entry section 36 for engaging with the projecting dispensing spout 35 on one end and an orifice 15 on the other. The fluid passageway 41 and the dispensing head 14 provide a means for the chemical 13 to be discharged into and directed from when the projecting dispensing spout 35 of the container 31 is forced into the entry section 36 by the spring 33 acting to move the slidably mounted container 31 in the direction of arrow 12. The funnel shape of the entry section 36 engages the projecting dispensing spout 35, which is made of a relatively soft material and therefore provides an adequate seal at the entry section 36 to retain fluid flow in the passageway 41 at pressures normally used in the pressurized container 31. Although the passageway 41 is shown as being contained in a rotatable dispensing head, it is recognized that the passageway can be formed in the body member 11.

Figure 14:
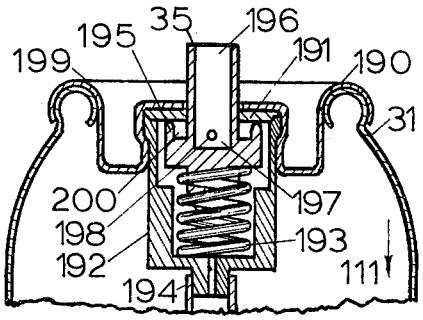
FIG. 14 is a partial vertical section showing a valve having a projecting spout for use with a pressurized container.

One type of pressurized container 31, shown as having a fluid-dispensing element in the form of a projecting dispensing spout 35, for use in this embodiment is shown in FIG. 14 as containing a valve assembly generally designated 190. Valve assemblies of this type are well known in the trade and one type of which is sold by Scovill, Manchester, N.H. as their S-63 valve assembly. The valve assembly 190 is shown as being comprised of a projecting dispensing spout 35 which as generally a hollow tube portion 196 and is closed at one end 197 thereof. A valve seat 195 is formed around the sealed end 197 of the dispensing spout 35 and contains a recessed portion 200 formed to provide a fluid passageway which will permit fluid flow to a discharge hole 198 and gives fluid access to the hollow tube 196. The dispensing spout 35 is slidably mounted in spring cup 192 and is urged by spring 193 toward the valve seal 191. In this position, the valve seat 195 forms a seal with the valve seal 191. A dip tube 194 may be attached to the spring cup 192 to provide access to fluid when in liquid form in the bottom of the container 31. The assembly is generally mounted in a metal cup 199 which is then fastened to the container 31.

When the projecting dispensing spout 35 is moved in direction 111, the valve seat 195 is separated from the valve seal 191 thereby, permitting fluid under pressure to flow up dip tube 194, around the valve seat 195, through the discharge hole 198 and out the hollow tube 196.

The container 31 in the position illustrated in FIG. 4 is in its cocked position where the spring 33 is compressed and the projecting dispensing spout 35 is coaxial but not seated in the entry section 36. The pressurized container 31 is releasably restrained in a cocked position by trigger 7. The trigger 7 is shown for convenience as being generally a flat member and includes a shaped latch portion 29, holes 24 and 19 and a notch 20 and is best seen in FIGS. 4 and 5. The trigger 7 is rotatably mounted on a pivot pin 23 and is slidably contained in slot 40 formed by the body halves 21 and 22. The shaped latch portion 29 engages the rim 38 of the container 31 when in the cocked position as shown in FIG. 4. The spring 33 urged pressurized container 31 causes trigger 7 to rotate counterclockwise as shown in FIG. 4 around pivot pin 23 and therefore will be spring biased against the exterior surface of the pressurized container 31 at 56, thus retaining the pressurized container 31 in its cocked position.

A means for locking the pressurized container 31 in its cocked position and the trigger 7 in its actuation position is shown for convenience as being comprised of a safety pin 16 mounted to prevent movement of trigger 7. The pin 16 passes through passage 17 in the left body half 21 a passage 19 in trigger 7 and a passage 18 in the right body half 22 as shown in FIGS. 4, 5, and 6. All passages are transverse to the longitudinal axis of the pressurized container 31 and are aligned when the pressurized container 31 is in its cocked position as seen in FIGS. 4 and 6.

A trigger actuating means associated with trigger 7 and arranged to actuate trigger 7 is shown for convenience as including a cord 5. A notch 20 is provided near the end of trigger 7 for receiving cord 5. The cord 5 is connected at one end to the window sash 3 and at its other end to the trigger 7 by being looped over trigger 7 to engage in notch 20. When it is desired to place the device in condition for discharge upon opening of sash 3, the safety pin 16 is removed from passages 17, 18 and 19. If the window sash 3 is opened by a burglar or other intruder, the cord 5 will rotate the trigger 7 moving the trigger latch 29 out of engagement from rim 38 of the pressurized container 31, and permitting the pressurized container 31 to be thrust toward the entry section 36 of the passageway 41 in the body member 11 by means of spring 33 to the position illustrated in FIG. 5. In this position, the entry section 36 depresses the dispensing spout 35 of the pressurized container 31 causing the chemical 13 to be discharged through the passageway 41 then into the area to be protected as shown in FIG. 2.

It is also important in this embodiment that the fluid-dispensing element comprises of a dispensing valve 190 having a projecting dispensing spout 35 which when depressed causes fluid discharge therethrough. The fluid passageway 41 contains the fluid dispensing-actuating means in the form of a funnel shaped entry section 36 which engages the projecting dispensing spout 35 and forms a seal between the entry section 36 of passageway 41 and the projecting dispensing spout 35.

It is an important feature that the trigger 7 be rotatable in this embodiment and that the trigger latch 29 slide freely on the rim 38 of the pressurized container 31 and, hence, present a surface which will ride smoothly when the trigger 7 is pulled. As a consequence, the trigger 7 may be easily withdrawn from engagement without substantial force. Yet, when the trigger 7 is positioned in engagement with rim 38 on the pressurized container 31 it serves to positively retain the pressurized container 31 in its cocked position. Hence, substantially less force is required to trigger the device 6 of the present invention than would be required if the pressurized container 31 were retained in its cocked position by means of a transversely extending trigger, yet, the pressurized container 31 is still safely retained in its cocked position against accidental release by the trigger 7.

Another important feature is that the spring 33 be of substantial force so that pressurized container 31 will depress the dispensing spout 35 sufficiently to cause the chemical 13 to be discharged from the dispensing spout 35 of the pressurized cylinder 31.

Yet another important feature is that the dispensing head 14 is rotatable in socket hole 42 through a large angle up to 360 degrees so that the chemical 13 may be directed into any area relative to the triggering object such as when it is desired to spray into the area after an unauthorized person moves a triggering object or entryway at a corner of the area to be protected.

If it is desired to utilize the chemical anti-burglar device 6, it is arranged as illustrated in FIG. 1. If it is desired to render it temporarily inoperative, the safety pin 16 is inserted through the passages 17, 18 and 19 to lock the trigger 7 and thence the container 31 in its cocked position.

Figure 21:
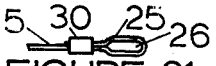
FIG. 21 is a horizontal view showing the shape of the loop for insertion over the trigger.

Another important feature is that the slot 48 in body halves 21 and 22 for inserting the looped cord 5 be made with a minimum clearance for the looped portion of the cord 5. It is also important to keep the opening 26 of the loop 25 of cord 5, as shown in FIG. 21, just wide enough to slip over the end of trigger 7 by keeping the loop 25 and the slot 48 in body halves 21 and 22 as narrow as possible; it becomes very difficult, if not impossible, to move the trigger 7 without a specially shaped loop or hook placed in slot 20 of trigger 7. This is necessary to keep small children from accidentally triggering the device.

Further security from accidental release is achieved by keeping the trigger 7 flush with or recessed from the exterior surface of the body halves 21 and 22. By mounting the trigger 7 in the body halves 21 and 22 in this manner, there is no surface of the trigger 7 exposed to grip and therefore cannot be released.

Figure 7:
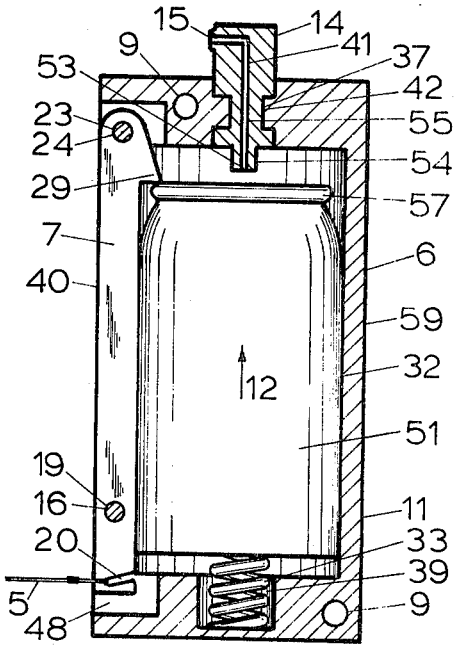
FIG. 7 is a vertical section similar to FIG. 4 but showing a second embodiment of the anti-burglary device containing a pressurized container but with a recessed valve.

A second embodiment of the invention is illustrated in FIG. 7. In this embodiment the basic structure is as previously described and like numbers are used to indicate like or corresponding parts.

In this embodiment, the pressurized chemical container 31, shown in FIG. 4 as having a projecting dispensing spout 35, is replaced with a pressurized chemical container 51, shown in FIG. 7, having a recessed valve. Pressurized containers with a recessed dispensing valve are well known in the trade. In addition, the entry section 36 of the passageway 41 of the first embodiment shown in FIG. 4 is replaced with a passageway 41 having a projecting spout 54 and an entry section 53 all of which are shown in FIG. 7.

In this embodiment, all elements function as described in the first embodiment with the following difference. The pressurized container 51 is discharged by the action of the coil spring 33 forcing pressurized container 51 to engage with the projecting spout 54 of the passageway 41 whereby the recessed valve of the pressurized container 51 is depressed when the device is triggered and thereby effects discharge.

Figure 15:
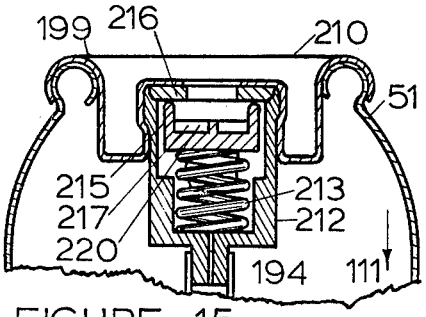
FIG. 15 is a partial vertical section showing a recessed valve for use with a pressurized container.

One type of recessed valve for use in this embodiment is shown in FIG. 15 and is generally designated 210. Valve assemblies of this type are well known in the trade and one type of which is sold by Scovill, Manchester, N.H. The valve assembly 210 is shown as being comprised of a valve seat 215 mounted in a spring cup 212. The valve seat 215 contains a recessed portion 220 and recessed channels 217 formed in valve seat 215.

The valve seat 215 is slidably mounted in spring cup 212 and is urged by spring 213 toward valve seal 216. In this position, the valve seat 215 forms a seal with the valve seal 216. The valve assembly 210 is generally mounted in a metal cup 199 which is then fastened to the pressurized container 51.

When the device is actuated, the valve assembly 210 is depressed by the projecting spout 54 of the passageway 41. As movement continues, the projecting spout 54 of the passageway 41 engages with and moves the valve seat 215 from engagement with valve seal 216 permitting fluid under pressure to flow around the valve seat 215 through the discharge channels 217 and out passageway 41. When the projecting spout 54 entered the valve assembly 210, the valve seal 216, being made of resilient material, formed a seal between the circumference of the projecting spout 54 and the valve seal 216, thus preventing fluid leakage.

The chemical 13 is then discharged through the valve 210 of the pressurized container 51, through the entry section 53 and passageway 41 and out the dispensing head 14, then into the area to be protected.

It is important in this embodiment that the fluid-dispensing element comprises of a recessed valve assembly 210 which when depressed causes fluid discharge. It is also important that the entry section 53 of passageway 41 contain a fluid dispensing element-actuating means in the form of a projecting spout 54 which engages with the recessed valve assembly 210 and causes fluid discharge.

The chemical is then discharged through the valve of the pressurized container 51, through the entry section 53 and passageway 41 and out the dispensing orifice 15, then into the area to be protected.

Figure 8:
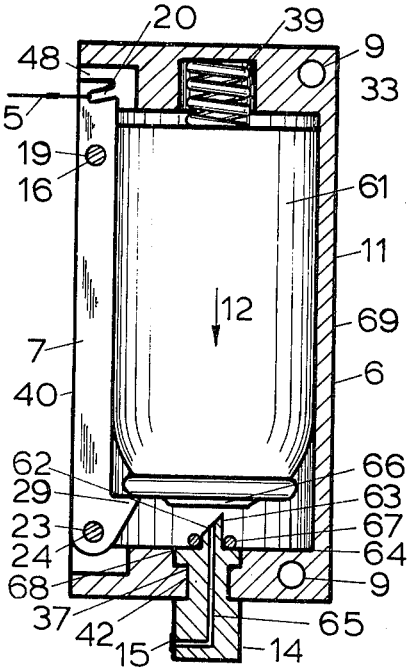
FIG. 8 is a vertical section similar to FIG. 4 but showing a third embodiment of the anti-burglar device containing a pressurized container of the type with a pierceable seal and a means for piercing the seal.

A third embodiment of the invention is illustrated in FIG. 8. In this embodiment the structure is as previously described in the first embodiment and like members are used to indicate like or corresponding parts.

In this embodiment, the pressurized container 31, shown in FIG. 4 of the first embodiment as having a projecting dispensing spout 35, is replaced with a pressurized container 61 shown in FIG. 8, having a pierceable seal 66. Pressurized container having pierceable seals are well known in the trade. In addition, the entry section 36 of the first embodiment shown in FIG. 4 is replaced with an entry section 62 having a projecting piercing spout 63 shaped to pierce seal 66 and a means of making a seal capable of withstanding the pressure required for effectively discharging the chemical through the passageway 65 and into the restricted area.

Now referring to FIG. 8, FIG. 8 is an inverted embodiment of FIG. 4 of the first embodiment in which all elements function as described in the first embodiment with the following exceptions. The pressurized container 61 when released by the trigger 7, is forced into pierceable engagement with the projecting piercing spout 63 formed around passageway 65 by the action of spring 33. As the pierceable seal 66 is pierced by the action of the projecting piercing spout 63, the pressurized container 61 continues to move by the urging of the spring 33 forming a seal by the action of the O-ring 67 and its retaining seat 68 and the pierceable seal 66 of the pressurized container 61. The chemical 13 is then discharged through the pierced seal 66 of the pressurized container 61, through passageway 65, out the orifice 15, and then into the area to be protected.

It is important in this embodiment that the fluid-dispensing element comprises a pierceable seal 66 which when pierced will permit fluid discharge therethrough. It is also important that the dispensing element-actuating means comprise of a projecting piercing spout 63 set in a position to pierce the pierceable seal 66 when the pressurized container 61 is moved toward it. It is also important that a seal be made around the projecting piercing spout 63 to prevent fluid leakage within the body member 11 after the pierceable seal 66 is pierced.

Figure 9:
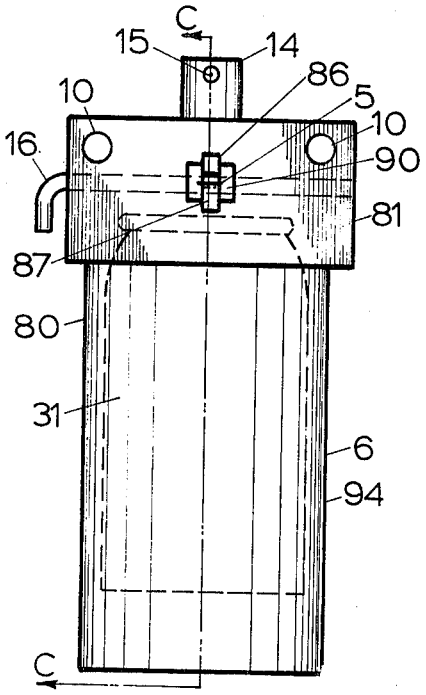
FIG. 9 is a front elevational view of the chemical dispensing device showing an alternate type construction and a slideable trigger.
Figure 10:
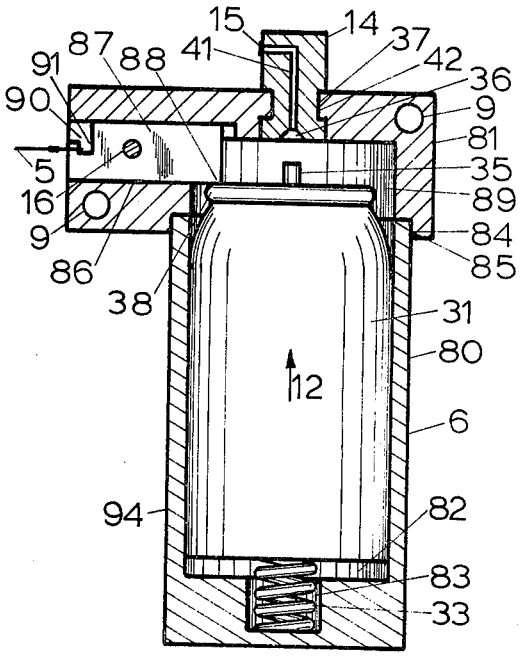
FIG. 10 is a vertical section taken along line C—C of FIG. 9 showing the device in its cocked position.

The preceding embodiments of the invention show the chemical dispensing anti-burglary device in its preferred embodiments having a rotatable trigger 7 designed for mechanical advantage but it is recognized that the trigger may be slidably mounted as shown in FIGS. 9 and 10.

Therefore a fourth embodiment of the invention is illustrated in FIGS. 9 and 10. In this embodiment the basic structure is as previously described in the first embodiment and like numbers are used to indicate like or similar parts.

In this embodiment, as shown in FIGS. 9 and 10, the body member 94 is constructed of a lower body section 80 and an upper body section 81. The exterior of lower body section 80 is round in shape while the interior comprises of two coaxial cylindrical bores 82 and 83. The cylindrical bore 82 slidably supports the pressurized container 31 and the cylindrical bore 83 serves to mount the spring 33.

The upper body section 81 is rectangular in shape and contains a round bore 84 sized to receive the upper most portion 85 of the lower body section 80 as shown in FIG. 10. Adhesives may be used to fasten the two body sections 80 and 81 after assembly.

A slot 86 is formed in the upper body section 81 to slideably mount a flat trigger 87. It is important that the catch 88 on the trigger 87 slide freely on the flange 38 of pressurized container 31 and also in the slot 86.

A cylindrical bore 89 must also be formed in the upper body section 81 to provide clearance for the pressurized container 31. A fluid passageway 41 and an entry section 36 must also be formed in upper body section 81 which is coaxial with but displaced from the dispensing spout 35 of container 31.

A wide slot 90 is provided where the cord 5 is slipped in the slot 91 in the trigger 87. It is important that this slot be no wider then required for the clearance of the cord 5 to prevent someone from accidentally triggering the device when the cord is removed.

An additional safety is provided by a safety pin 16 which operates in a manner previously described.

When it is desired to actuate this device, the cord 5 is connected in slot 91 of trigger 87 and the safety pin 16 is removed as previously described. An intruder causing the cord 5 to be pulled will slide the trigger 87 from engagement with the container 31. Thus permitting the spring 33 to move the container 31 in a manner to cause the dispensing spout 35 to move into engagement with the entry section 36 of the fluid passageway 41 and cause discharge in a manner previously described.

This type of trigger does not have the mechanical advantage of the rotatable trigger and requires more force to release the container but can be effectively used for many applications.

Figure 13:
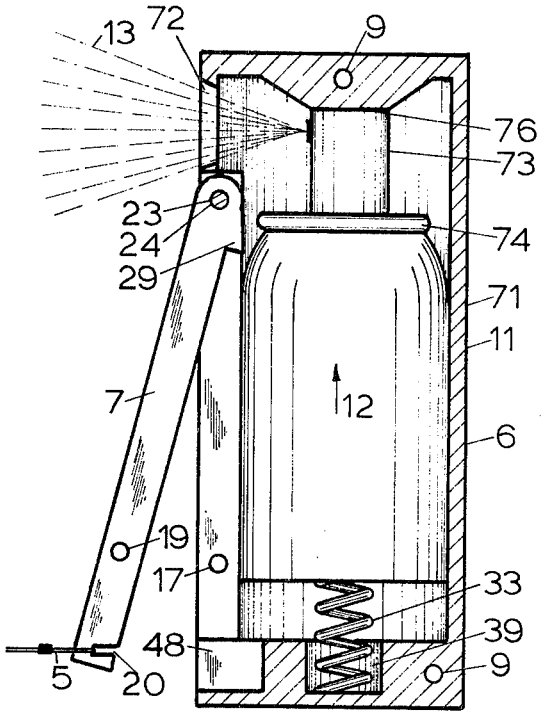
FIG. 13 is a vertical section taken along line D—D of FIG. 11 but showing the pressurized container in its released position after the device has been triggered.
Figure 11:
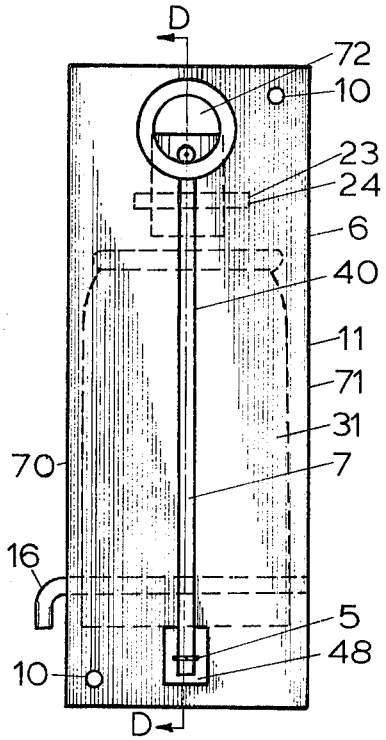
FIG. 11 is a front elevational view similar to FIG. 3 but showing a fifth embodiment of the chemical dispensing anti-burglary device containing a pressurized container of the aerosol type with a projecting cap.
Figure 12:
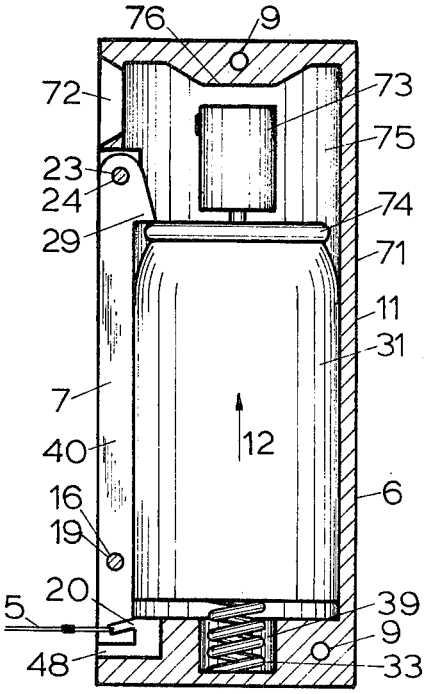
FIG. 12 is a vertical section taken along line D—D of FIG. 11 showing the pressurized container in a cocked position.

A fifth embodiment of the invention is illustrated in FIGS. 11, 12 and 13. In this embodiment, the structure is as previously described in the first embodiment and like numbers are used to indicate like or corresponding parts.

In this embodiment, the projecting dispensing spout 35 of pressurized chemical container 31, shown in FIG. 4, is replaced with a projecting dispensing cap 73 shown in FIG. 11, 12 and 13. In addition, the fluid passageway 41 and the entry section 36 are replaced with an aperture 72.

Now referring to FIG. 12 and FIG. 13, the trigger 7 and the spring 33 operate as before to move the pressurized container 31. In this embodiment, the spring 33 urged pressurized container 31 causes the projecting cap 73 to be depressed against the inside top portion 76 of body halves 70 and 71; thereby causing discharge through aperture 72.

It is important in this embodiment that the discharging means comprises a valved pressurized container 31 having a projecting dispensing cap 73 which when depressed causes fluid discharge therethrough. The body member 11 contains an aperture 72 in communication with the projecting dispensing cap 73 to provide for fluid discharge from body member 11. It is also important that the body member 11 provides surface 76 which will depress the dispensing cap 73 when the pressurized cylinder 31 is released to cause discharge.

It should be noted that the dispensing cap 73 can be mounted wherein there is clearance between the dispensing cap 73 and the inside top portion 76 of the body member 11, as shown in FIG. 12; or the dispensing cap 73 can be mounted without said clearance. In either case, no fluid can be discharged unless the dispensing cap 73 is forced against the inside top portion 76 of the body member 11. Therefore in this embodiment, the dispensing element actuating means comprises the dispensing cap 73 and the inside top portion 76 of the body member 11. When the spring biased pressurized container 31 is released, the container 31 moves in the direction of 12 until the dispensing cap 73 is stopped against the inside top portion 76 of body member 11. At this time, the dispensing cap 73 and the top inside portion 76 of body member 11 combine to become the dispensing element actuating means. Continued movement of container 31 will then cause the fluid-dispensing element which can be a valve as shown in FIG. 14 or FIG. 15 and described earlier, to be actuated.

A sixth embodiment of the invention is illustrated in FIGS. 16–20. In this embodiment the basic structure is as previously described in the first embodiment and like numbers are used to indicate like or corresponding parts.

In the anti-burglar device 6 previously described, the trigger 7 is released when cord 5 is pulled wherein, the trigger 7 holds the pressurized container 31 in a cocked position. Rather than in this embodiment, the trigger 7 is replaced by a trigger 107 wherein the trigger 107 will be forced to rotate in the direction of arrow 153 by the action of the plunger 131 of the electromechanical actuator 133. The operation of this trigger 107 will become apparent in the following description.

Figure 16:
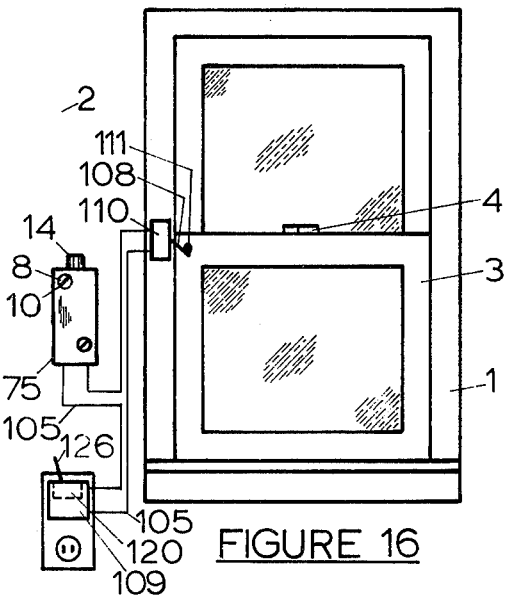
FIG. 16 is an elevational view of a wall of a room having the sixth embodiment of the chemical dispensing anti-burglary device of the present invention secured to a wall and electrically connected to a switch at the window.
Figure 19:
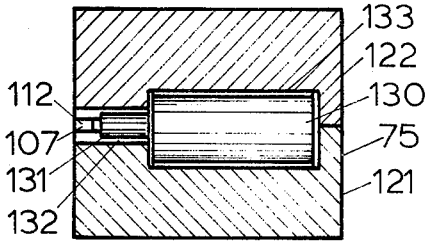
FIG. 19 is a partial horizontal sectional taken along line F—F of FIG. 18 showing the electromechanical actuator of the anti-burglary device wherein the trigger element is electromechanically controlled.
Figure 20:
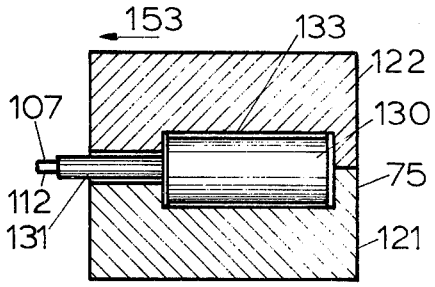
FIG. 20 is a horizontal section taken along line F—F of FIG. 18 similar to FIG. 19 but showing the electromechanical actuator in its release position.
Figure 17:
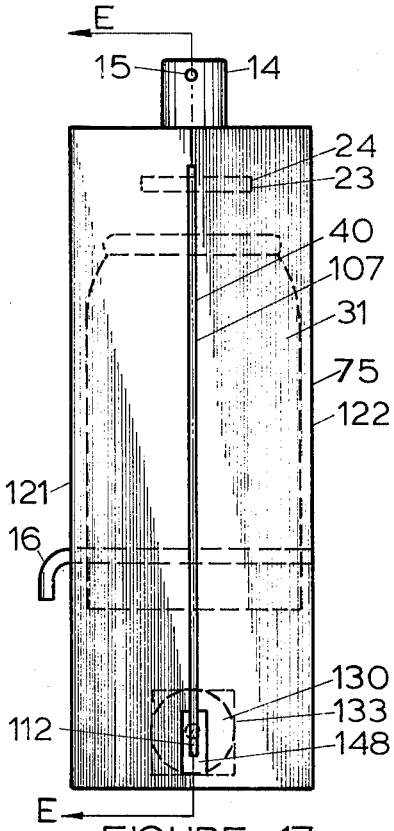
FIG. 17 is a front elevational view similar to FIG. 3 but showing a sixth embodiment of the anti-burglar device containing a pressurized container with a projecting spout for electromechanical operation.
Figure 18:
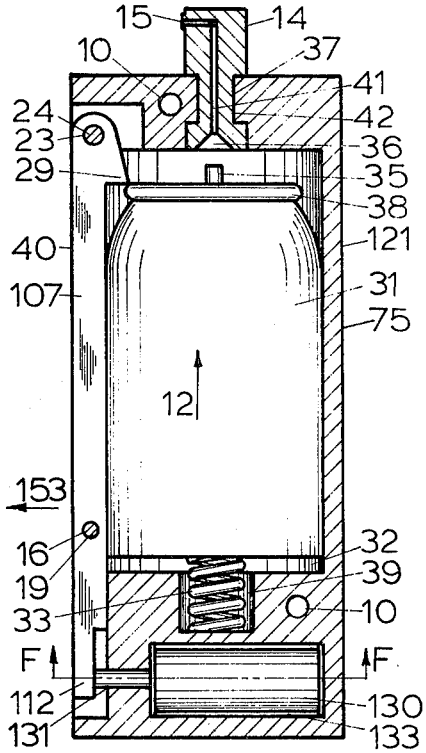
FIG. 18 is a vertical section taken along line E—E of FIG. 16 showing the pressurized container in a cocked position.

As shown in FIG. 16, the device 75 can be remotely mounted from a window or other object or entryway to be protected and connected by means of an electrical cable 105 to an electrical switch 110; an on-off switch 120 and a power source 109, so that upon opening the window sash 3 by an unauthorized person, the contacts of switch 110 will close as a result of switch actuation pin 111 releasing contact lever 108 of switch 110 electromechanically causing the device 106 to discharge the chemical 13 into the area to be protected. This embodiment of the device comprises of all the components previously described except for the change in the method of triggering previously described and an addition of an electromechanical actuator 133.

As the window 3 is raised, the electromechanical actuator 133 shown for convenience as a solenoid coil 130, is energized and the plunger 131, acting on an extension 112 of trigger 107, moves the trigger 107 from its actuation position to a release position. This releases the pressurized container 31 and discharges the device as previously described.

The chemical dispensing anti-burglary device described herein in several embodiments was generally shown with a pressurized container 31 with a projecting dispensing spout 35 mounted to discharge into a funnel like entry section 36 of a fluid passageway 41 when the device is discharged. Alternately the device will also function with a pressurized container of the aerosol type with a recessed valve by providing a tubular member depending from the body member to cause discharge; in addition the devices can be used with a sealed pressurized container with a piercable seal; the aerosol type container with a dispensing projecting cap may also be used wherein the projecting cap is depressed to cause discharge; but the invention is not limited to these type of containers.

Although I have herein shown and described the invention in what I have conceived to be the most practical and preferred embodiments, it is recognized that departure may be made therefrom within the scope of my invention, which is not to be limited to the details disclosed herein, but is to be accorded the full scope of the claims so as to embrace any and all equivalent structures and devices.

I claim:

1. A chemical dispensing anti-burglary booby trap device for attachment to a surface such as a wall and associated with a movable surface such as a window to prevent burglary by filling the area associated with said device with a chemical such as tear gas when unauthorized movement of said movable surface is attempted, the device comprising:

(a) a body member having mounting means for the attachment of said body member to one surface;

(b) a pressurized container slidably supported in said body member, said pressurized container having a fluid-dispensing element adapted to release fluid under pressure when actuated;

(c) a fluid passageway extending through a wall of said body member having an entry section at one end thereof and means for directing fluid discharge from the other end thereof;

(d) dispensing element actuating means located and arranged in said body member wherein movement of said dispensing element actuating means is restrained by said body member, said dispensing element actuating means adapted to engage and actuate said fluid-dispensing element upon movement of said pressurized container;

(e) spring biasing said pressurized container whereby said fluid-dispensing element is forced into engagement with said dispensing element actuating means thereby causing said fluid-dispensing element to be actuated;

(f) means for providing a seal between said fluid-dispensing element and said element actuating means whereby fluid will flow therethrough without permitting fluid leakage into said body member;

(g) a latch mechanism trigger mounted for movement between an inoperative position and a release position, said latch mechanism trigger in said inoperative position adapted to latch said spring biased pressurized container in a cocked position wherein said fluid dispenser element is held in an inactuatable position;

(h) and means for moving said latch mechanism trigger from said inoperative position to said release position when said movable surface moves from a first position to a second position, said latch mechanism trigger in said release position moving said latch from engagement with said spring biased pressurized container to release said spring biased pressurized container from said cocked position whereby said spring biased pressurized container moves said dispensing element past said latch position and into engagement with said dispensing element actuating means thereby actuating said fluid dispensing element to cause the discharge of fluid from said pressurized container.

2. The chemical dispensing anti-burglary device of claim 1 wherein said fluid dispensing element of said pressurized container includes a dispensing valve actuated to permit fluid discharge therethrough upon depression thereof, said valve being actuated to a release position through movement of said spring biased pressurized container acting to move said slidably mounted pressurized container to cause depression of said valve, thus causing discharge.

3. The chemical dispensing anti-burglary device of claim 2 wherein said valved pressurized container contains a projecting dispensing spout, said dispensing spout discharging fluid upon depression thereof, said entry section of said passageway being funnel shaped for receiving said projecting dispensing spout on said container.

4. The chemical dispensing anti-burglary device of claim 2 wherein said valved pressurized container includes a recessed valve, said body member includes a projection around said entry section extending beyond said entry section toward said container to engage said recessed valve, said recessed valve actuated upon depression thereof to emit fluid.

5. The chemical dispensing anti-burglar device of claim 2 wherein said valved pressurized container contains a projecting dispensing cap actuated to permit fluid discharge therethrough upon depression thereof, means for restricting movement of said projecting dispensing cap by said body member, an aperture in said body member in communication with said cap, said slidably supported pressurized container arranged to actuate said dispensing cap upon release thereby discharging fluid from said pressurized container through said cap and aperture when said pressurized container is released.

6. The chemical dispensing anti-burglar device of claim 1 in which said fluid-dispensing element of said pressurized container comprises a pierceable section, means to provide a seal between said pierceable section and said entry section, and means for puncturing said pierceable section as the container is released, whereby fluid may be discharged.

7. The chemical dispensing anti-burglary device of claim 6 in which said means for puncturing comprises a projecting spout depending from said body member.

8. The chemical dispensing anti-burglar device of claim 1 wherein said trigger is mounted for rotation between an actuation position and a release position, said trigger when in said actuation position retaining said spring biased pressurized container in a cocked position, and said trigger when in said release position allowing said spring biased pressurized container to actuate said fluid-dispensing element by engaging said dispensing element activating means thereby causing fluid discharge.

9. The chemical dispensing anti-burglary device of claim 1 wherein said trigger element is mounted for sliding movement between an actuation position and a release position, said trigger when in said actuation position retaining said spring biased pressurized container in said cocked position, and said trigger when in said release position allowing said spring biased pressurized container to actuate said fluid-dispensing element by engaging said dispensing element activating means, thereby causing fluid discharge.

10. The chemical dispensing anti-burglary device of claim 1 wherein said trigger when in an actuation position is in shouldered engagement with said pressurized container to retain said pressurized container in a cocked position.

11. The anti-burglary chemical dispensing device of claim 1 wherein said trigger actuating means associated with said trigger comprises a means for electromechanically moving said trigger element to a release position.

12. The chemical dispensing anti-burglary device of claim 1 wherein said trigger-actuating means associated with said trigger comprises a means for moving said trigger element from an actuation position to a release position, said trigger moving means including a means for attaching a cord to said trigger, said cord arranged to cause movement of said trigger.

13. The chemical dispensing anti-burglary chemical dispensing device of claim 1 wherein said trigger actuating means associated with said trigger comprises a solenoid containing an electromagnetic coil and a plunger, said electromagnetic coil and plunger being mounted to cause release of said trigger element when said electromagnetic coil is electrically energized.

14. The anti-burglary device of claim 1 wherein there is a means to safely retain said trigger element, said retaining means including a pin, said pin being mounted for an insertion position and a removable position, said pin in said insertion position being mounted through a hole in said body member in a manner to prevent movement of said trigger element, said removable position having pin removed permitting movement of said trigger element when actuated.

15. The chemical dispensing anti-burglary device of claim 1 wherein said dispensing element actuating means is mounted in said body member.

16. The chemical dispensing anti-burglary device of claim 1 wherein said passageway includes a dispensing nozzel for directing said fluid discharge when said fluid-dispensing element is actuated.

17. The chemical dispensing anti-burglary device of claim 16 wherein said dispensing nozzel is rotatably mounted.

* * * * *